US006026510A

United States Patent [19]

Kocher

[11] Patent Number: 6,026,510

[45] Date of Patent: Feb. 22, 2000

[54] BULLET DEFLECTION, FIGHTING POSITION BODY ARMOR

[76] Inventor: Robert William Kocher, P.O. Box 4613, Troy, Mich. 48099

[21] Appl. No.: 09/164,252

[22] Filed: Sep. 30, 1998

Related U.S. Application Data

[60] Provisional application No. 60/070,231, Dec. 31, 1997.

[51] Int. Cl.[7] ..... F41H 1/02

[52] U.S. Cl. ..... 2/2.5; 2/16

[58] Field of Search ..... 2/2.5, 16

[56] References Cited

U.S. PATENT DOCUMENTS

| | | | |
|---|---|---|---|
| 1,294,191 | 2/1919 | Suderlock | 2/2.5 |
| 3,958,276 | 5/1976 | Clausen | 2/2.5 |
| 5,044,011 | 9/1991 | Henderson | 2/2.5 |
| 5,157,792 | 10/1992 | Allen et al. | 2/2.5 |
| 5,327,811 | 7/1994 | Price et al. | 2/2.5 |
| 5,771,489 | 6/1998 | Snedeker | 2/2.5 |
| 5,935,678 | 8/1999 | Park | 2/2.5 |

*Primary Examiner*—Diana Oleksa

[57] ABSTRACT

Bullet Deflection, Fighting Position Body Armor incorporates a novel bullet defeat mechanism approach different than conventional armor's objective of stopping bullets. Many rifle bullets that are used for military assault rifles are designed to turn or tumble on contact allowing maximum energy to be imparted on the target in minimal penetration distance. Exploiting this bullet/rifle design, deflecting bullets becomes a new attractive solution rather than stopping bullets because significantly less weight required to deflect an "unstable" bullet. Fighting position body armor can be mounted on the user's arms, shoulders and helmet. These locations are not normally protected by conventional body armor thereby providing significant protection when the soldier is in firing/fighting positions. Designs can be made to integrate the Bullet Deflection, Fighting Position Body Armor areas of protection with conventional body armors to optimize weight and areas protected.

27 Claims, 6 Drawing Sheets

BULLET DEFLECTION, FIGHTING POSITION BODY ARMOR

A. TITLE OF INVENTION

Bullet Deflection, Fighting Position Body Armor

B. CROSS REFERENCE TO RELATED APPLICATIONS

This application claims the benefit of provisional application No. 60/070,231, filed Dec. 31, 1997.

C. STATEMENT REGUARDING FEDERALLY SPONSORED RESEARCH OR DEVELOPMENT

Not Applicable

D. REFERENCE TO A MICROFICHE APPENDIX

Not Applicable

E. BACKGROUND OF INVENTION

Conventional bullet defeating body armors protect the user's chest and back. Protection is normally good when the user is standing erect and facing the threat or in the case of body armor with a back plate, when threat is directly to the rear. A user, with a rifle, normally returns fire from the prone position or from behind a protective structure. The prone position places the chest plate on the ground and the back plate up in the air rendering them relatively useless with respect to the threat direction. When firing from behind a protected structure, the user is exposed to bullets above the chest plate. Conventional body armors are ineffective to bullets above the top of the chest plate. This deficiency in conventional body armor is critical because in a direct fire situation where the soldier or law enforcement officer must return fire from a fighting position hoping to hit the enemy before he himself is wounded.

Most conventional body armors require substantial weight to stop a bullet and absorb the bullet's residual energy. Extremity protection has been manufactured with the concept of stopping light fragments. Extremity armors are not designed to stop bullets because the weight required to stop bullets would weigh down the individual to the point that his arms and legs would be ineffective due to the significant weight.

F. BRIEF SUMMARY OF THE INVENTION

Bullet Deflection, Fighting Position Body Armor (hereinafter referred to as BDBA) incorporates a novel bullet defeat mechanism approach different than conventional armor's objective of stopping bullets. Many rifle bullets that are used for military assault rifles are designed to turn or tumble on contact allowing maximum energy to be imparted on the target in a minimal penetration distance. Exploiting this bullet/rifle design, deflecting bullets becomes a new attractive solution rather than stopping bullets because of the significantly less weight required to deflect an "unstable" bullet. BDBA can be mounted on the user's arms, shoulders, and helmet providing significant protection when the soldier is in firing/fighting positions. These body locations are currently not protected by conventional body armor. Designs can be made to integrate the BDBA areas of protection with conventional body armors to optimize weight and areas protected. Since arm mounted armor is at low angles with respect to the bullets' line-of-flight, very thin and lightweight pieces can be used.

G. BRIEF DESCRIPTION OF THE SEVERAL VIEWS OF THE DRAWINGS

FIG. 1 shows a bullet (Item 1) fired at low angles with respect to the bullet's line-of-flight (Item 2) and the ballistic plate (Item 3) which can consist of materials such as steel, aluminum, titanium, other metals, composites, or ceramics. Since bullets are relatively unstable on impact, the oblique surface is a very difficult target for the bullet to perforate.

FIG. 2 shows the general results on a bullet (Item 1) traveling on line-of-flight (Item 2) impacting and deforming the ballistic plate (Item 3) and deflects off in the new line-of-flight (Item 4) along with impact fragments. The physics law for the conservation of energy shows that less impact energy is imparted on the structure when there is a ricochet of the surface. Residual energy remains with the ricochet bullet and fragments.

FIG. 3 shows a bullet (Item 1) traveling on a line-of-flight (Item 2) approaching a dual spaced ballistic plate (Item 3) which is configured to partially deflect the bullet but allow the bullet to perforate the first plate and complete the deflection process on the second plate. This two-piece plate arrangement increases the ballistic plate's performance and contains the deflecting bullet and fragments. This configuration is important for a user that is concerned with controlling the deflecting fragments.

FIG. 4 shows the bullet (Item 1) perforating the first plate (Item 5) and deflecting off of the second plate (Item 3). The fragments (Item 6) result from the high-speed bullet impact which will travel within the space between the plates preventing injuries from the deflections.

FIG. 5 shows the soldier in a prone position or behind a structure such as a wall with conventional body armor. The user's helmet is Item 8 and the user's rifle is Item 7. Conventional helmets are not designed to stop or deflect bullets. Note that conventional body armor provides very little protection on this common firing position. A bullet fired at the soldier and impacting on his outlined silhouette will surely result in a casualty. The solder knows this and is very concerned about being fired upon. Once receiving fire, he will normally seek better cover.

FIG. 6 shows a user wearing components of the BDBA system. Item 9 shows the upper arm armor ballistic pieces; Item 10 is the forearm ballistic component; Item 11 is the helmet component which will provide a defection surface for bullets at selected angles; Item 18 is the upper shoulder component. The user in this configuration has significantly more protection than the non-user in FIG. 5. The user's vulnerable areas have been significantly reduced and the user can remain in the firing position longer that an non-user and has a significant advantage over his opponent who's silhouette has more vulnerabilities.

FIG. 7 shows potential configurations of the upper and lower arm ballistic plates. FIG. 7A is a cross section of the forearm BDBA system; Item 12 is the user's forearm and Item 13 is a strap attachment system.

FIG. 8 is a cross section of a user's forearm with a more advanced configuration of the BDBA system. The ballistic plate can be hinged; Item 15 folds up from Item 16 on a hinge (Item 17). This configuration allows for the user to move easily with the system and deploy when needed. Item 12 is a cross section of the user's forearm; Item 14 is a support structure, similar to a light exoskeleton.

FIG. 9 is an example configuration of the BDBA's ballistic plates; Item 21 is the user's arm; Item 9 is the BDBA upper arm piece; Items 15 and 16 are forearm pieces;

Item 17 is the hinge that connects these pieces. This hinge arrangement allows the user to fold up the system during times when it is not needed yet be able to quickly open the system when required, Item 18 is a ballistic shoulder piece and Item 11 shows the helmet deflection components that would be added or designed into the helmet. Signature reduction technologies such as technologies such as infrared, visual, thermal, acoustic, radar, can also be integrated on or in the body armor. Surface coatings can reduce visual and radar. Insulation materials can reduce infrared, thermal and acoustic.

FIG. 10 shows the support component of the BDBA system. The support structure can be designed to reduce the armored plate's torque during normal use and upon ballistic impacts. The light exoskeleton can also have hinges and springs which can transfer weight loads of the armor system and additional equipment that the soldier is carrying. Item 21 is the user's arm. Item 14 is the support structure for attaching the ballistic plates to the arm which carries weight and ballistic loads. Item 20 is a hinge connecting the upper and lower pieces of the support system. Item 19 represents a support system that can be attached to the helmet to remove weight off of the helmet.

FIG. 11 is a less shaped configuration but serves as a chest plate and back plate similar to conventional body armor plates but these plates are quickly detachable from the vest which and contain an attachment system or are mounded on a light exoskeleton to provide protection in firing positions. This configuration would allow the utilization of two systems on one user for a situation in which the user is facing a high number threats from multiple directions. Item 22 is ballistic armor for the back and Item 23 is the ballistic armor for the chest.

FIG. 12 shows the ballistic plates detached from the user's back and chest and attached to the arms. The attachment system could be a simple straps or hook and loop system or a more sophisticated system such as the light exoskeleton. FIG. 12 shows a two piece system. A four piece system could be used whereby the user's back and chest would carry four pieces approximately half the current size and these smaller pieces would attach to the lower and upper arms or the shoulders. Item 22 is attached to the left fore arm and Item 23 is attached to the right.

Figure 15:
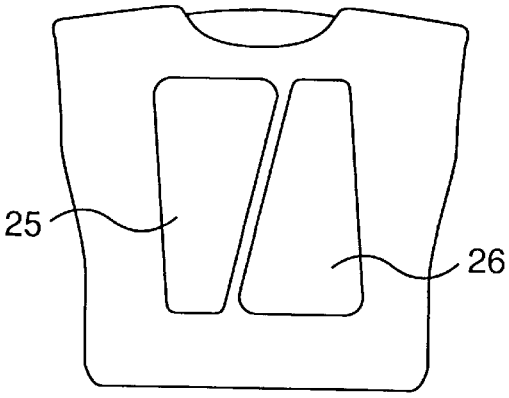

FIG. 15 shows arm components attached to the chest. This configuration functions like a conventional body armor place but allow the user to detach the plates and attach to portions of his arms or shoulders to provide ballistic protection in a firing position. Item 25 and Item 26 are the arm plates. A similar configuration can be applied to the back of the vest.

Figure 16:
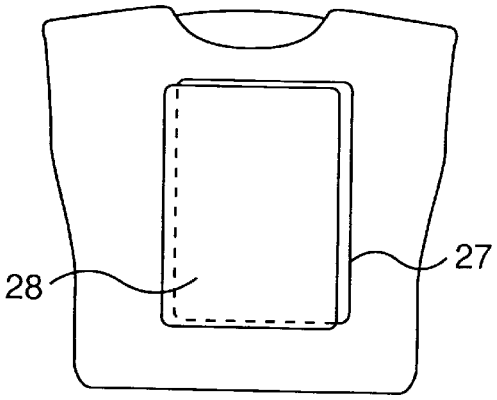

FIG. 16 shows larger arm components stored one on top of the other on the front or back of a vest. Item 27 and Item 28 are examples of BDBA stored on the front of a vest. Since bullet deflection required less material to deflect a bullet when compared to stopping a bullet, a single piece maybe sufficient for the arm and two pieces doubled may stop a bullet on the chest.

H. DETAILED DESCRIPTION OF THE INVENTION

Figure 3:
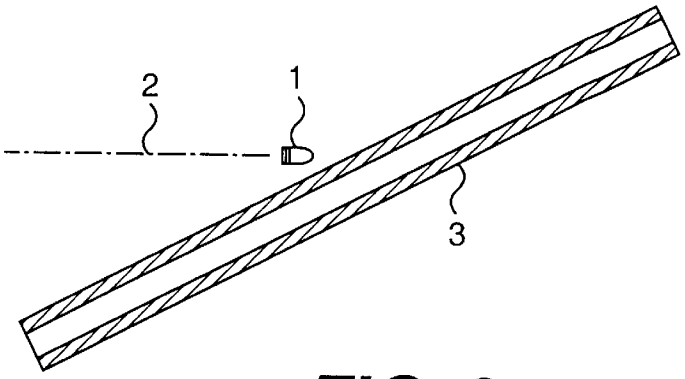
Figure 4:
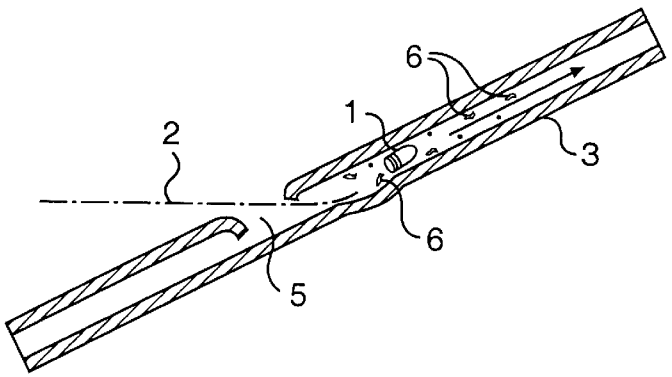
Figure 1:
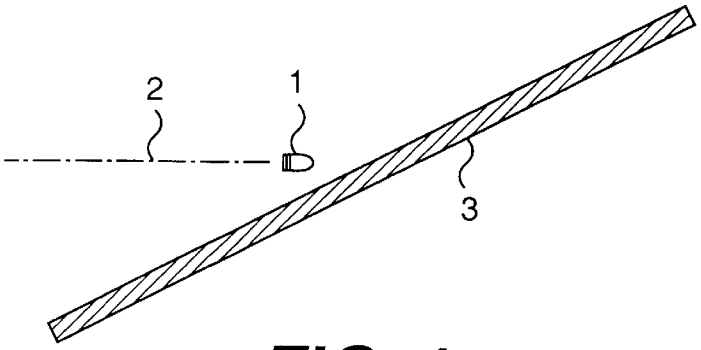
Figure 2:
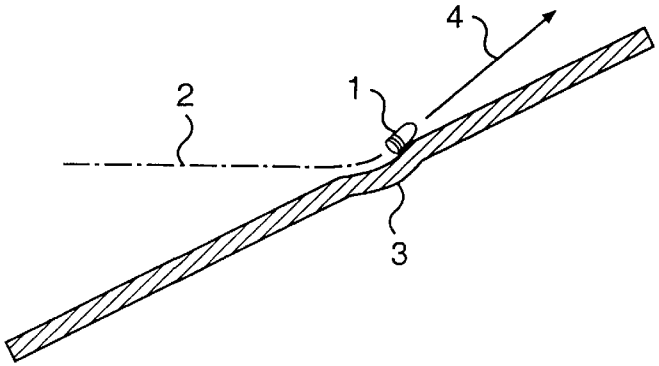
Figure 5:
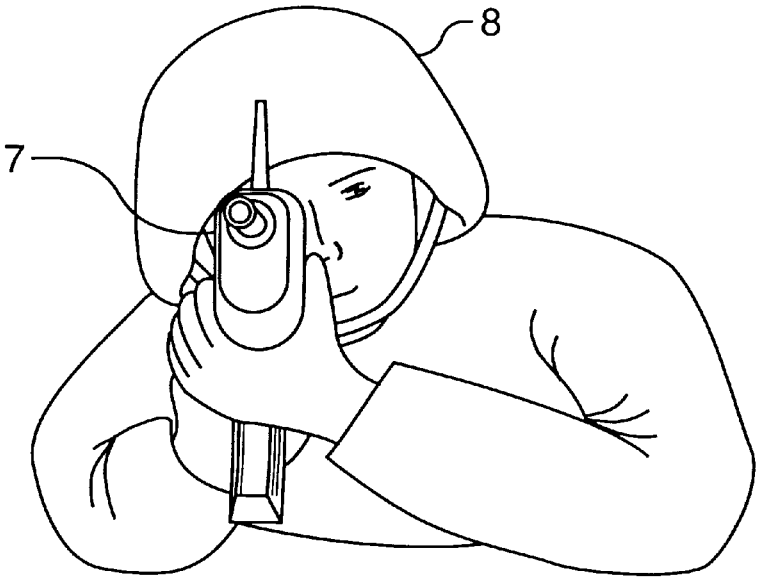
Figure 6:
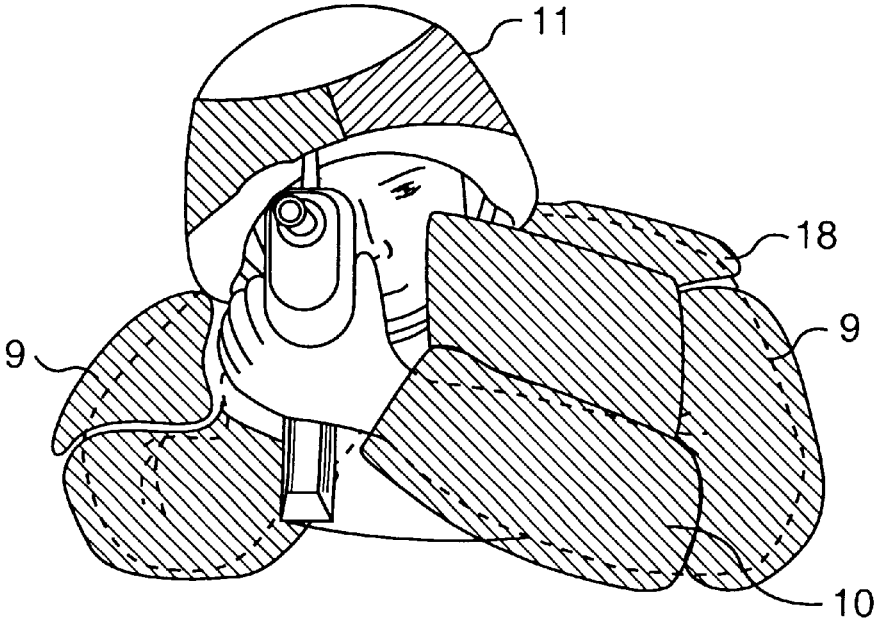
Figure 7:
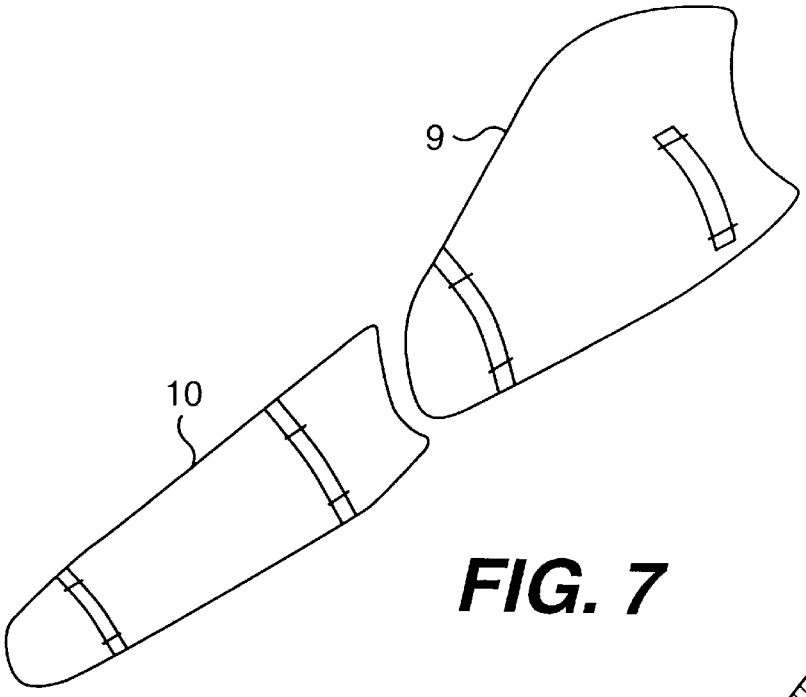
Figure 7A:
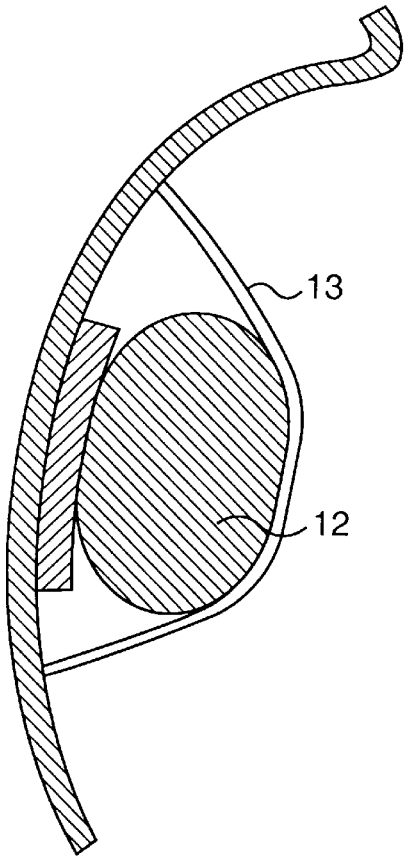
Figure 8:
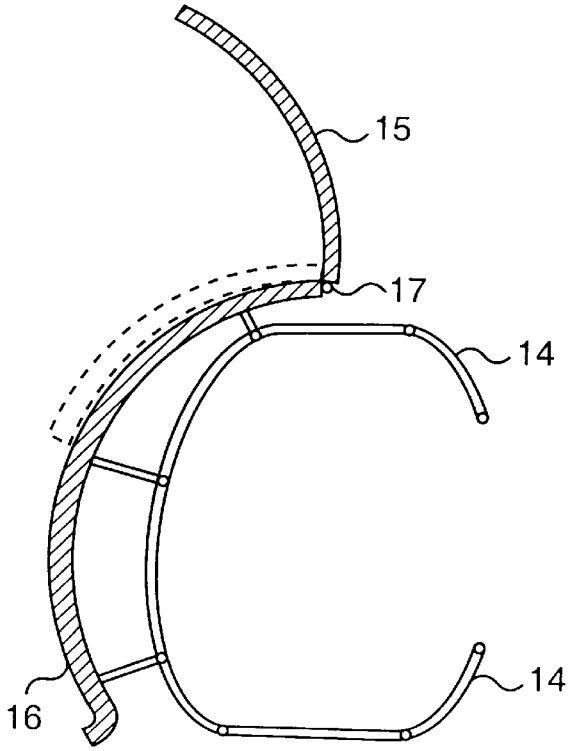
Figure 9:
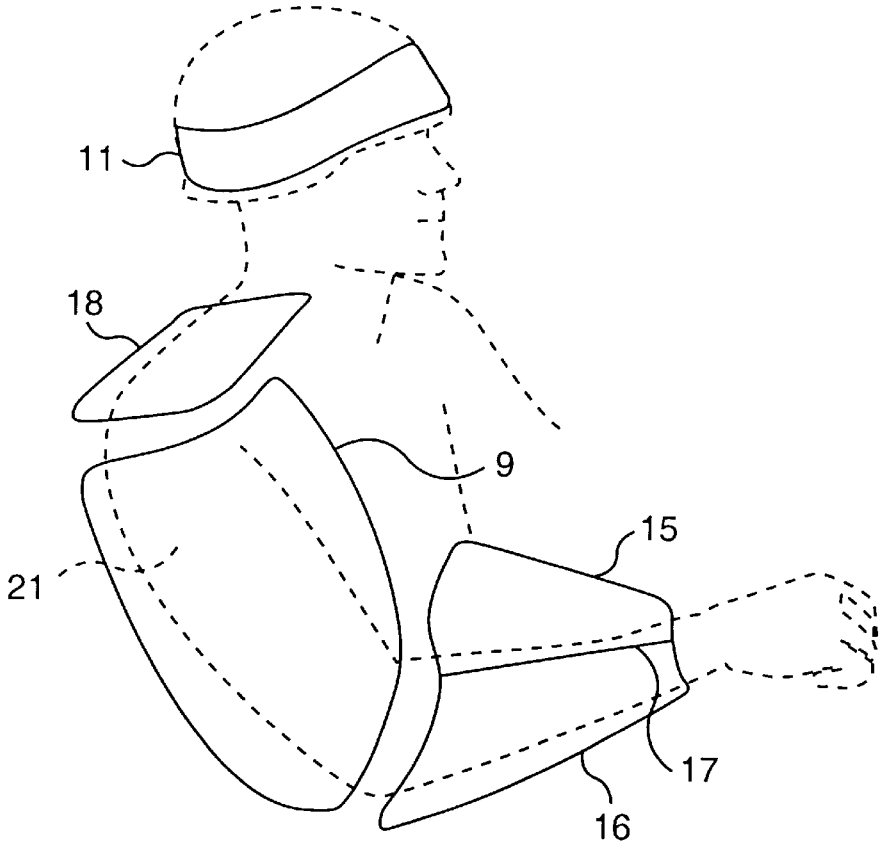
Figure 10:
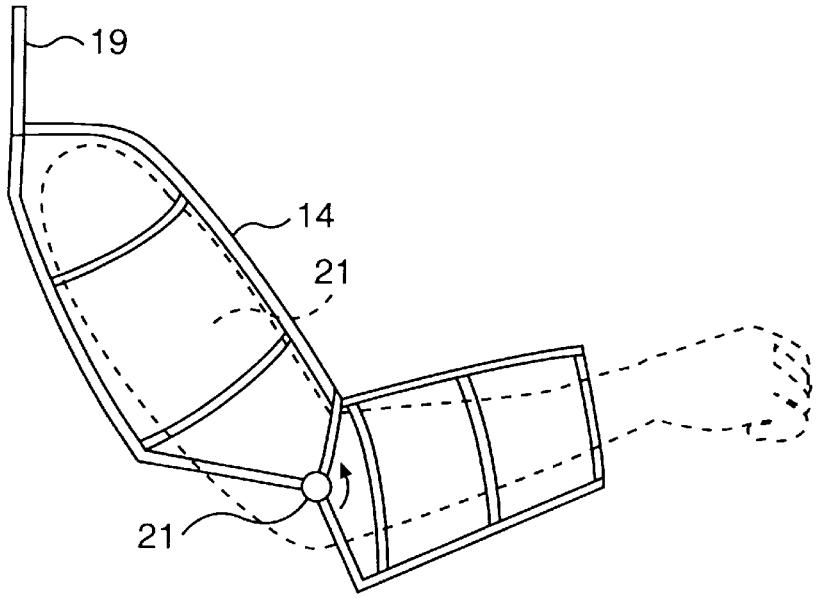
Figure 11:
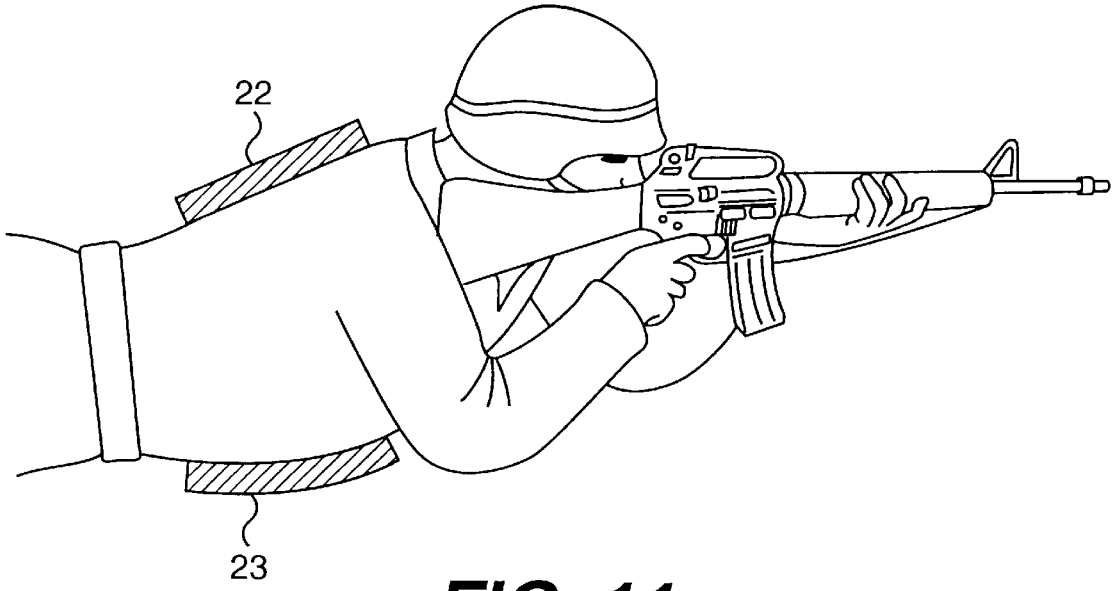
Figure 12:
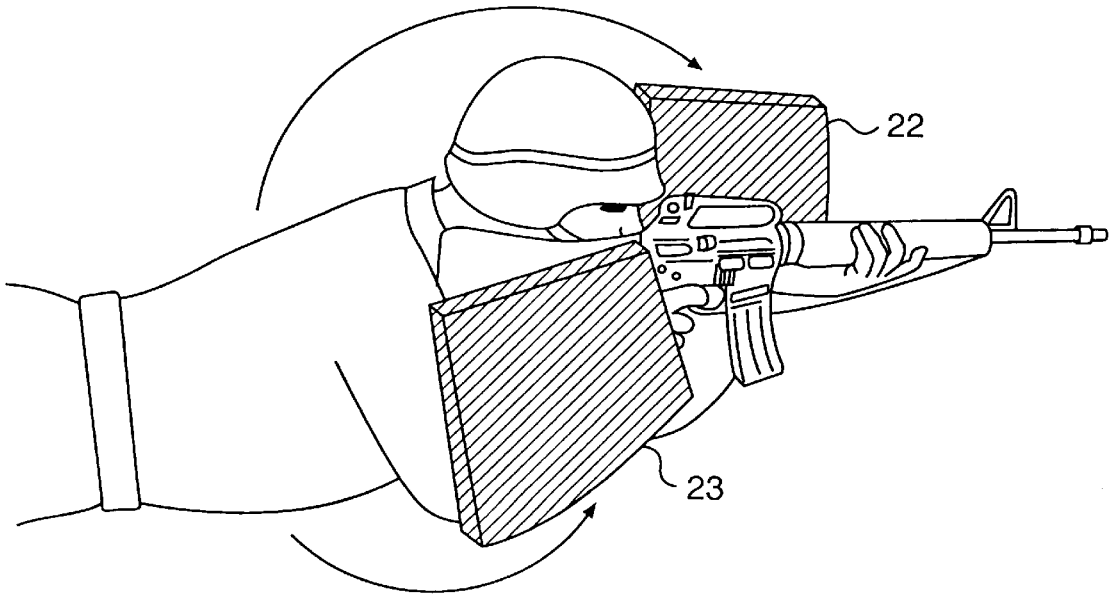
Figure 13:
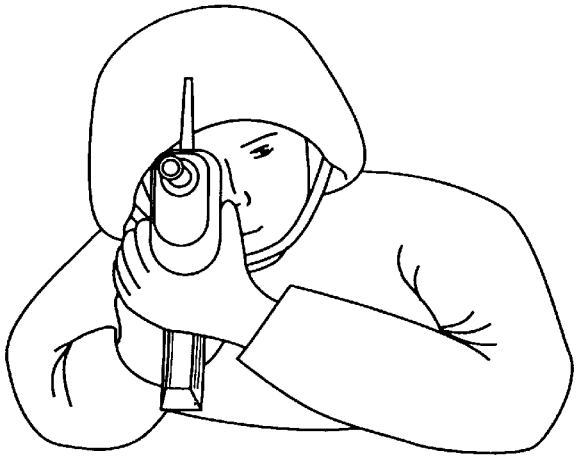
FIG. 13 shows the non-user in a fighting position with exposure of the entire silhouette and the lack of effectiveness of conventional armor's protection from frontal threats.
Figure 14:
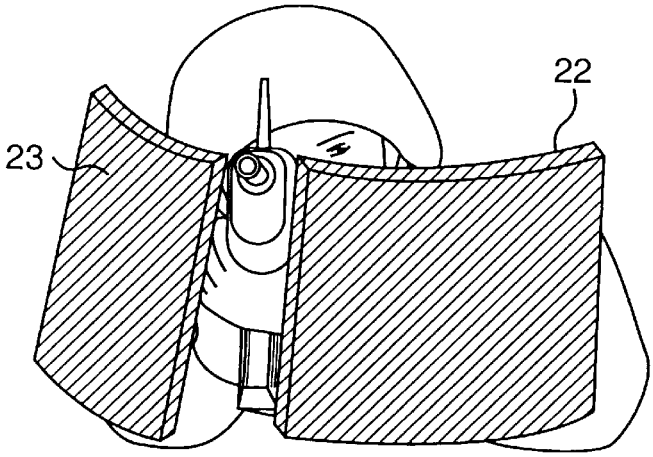
FIG. 14 shows the protection enhancement provided by a detachable BDBA chest and back mounted system. Item 22 is removed from the user's back and attached to the user's left arm and Item 23 is removed from the user's chest and attached to the user's right arm.

Bullet Deflection, Fighting Position Body Armor (BDBA) provides protection to areas of the user's body is not normally protected by conventional body armor. When a user fires a rifle (normal right-handed shooter), his upper body is turned to the right, his left arm and shoulder are forward, and exposed to the threat. Definition: firing and fighting position: Firing and fighting positions thus include as shown in FIGS. 5 and 6 normal stances holding a rifle at-the-ready or firing rifles during various operations such as, defending, attacking, advancing, withdrawing and when the users are stationary, moving, prone, erect, in-the-open, from behind cover, or concealed. Rifle firing positions are further characterized by orienting the rifle barrel to one side of the user and the rifle stock to the other as best shown in FIGS. 11 and 12. The user is normally in a half turned position with respect to the direction of firing. Firing and fighting positions using handguns can have orientations directly in front of the user's chest. From the aforesaid description and FIGS. 5 and 6; and FIGS. 11 and 12 a further definition of the protection of the present invention can be understood as follows: Definition: Side of user: The "side of a user" as set-forth herein can be understood to mean one-half of the body cut a vertical plane down through the user down middle head to the ground dividing the body into a right half and left half (right half includes right side of main body such as right shoulder, torso, neck, and hip; and, right side extremities include right arm, right half of the head and right leg.) Rifle firing of fighting positions normally a-symmetrical favor one side of the body. Due to deflection angles, angles of incidence, and firing position orientation BDBA mounted on the right side of a user may look different that that mounted on the left side. For handgun firing and fighting positions, BDBA can be designed as symmetrical. Since a firing/fighting position with a rifle typically involves firing to with the rifle stock resting in the right shoulder (right-handed firer) and the left hand outstretched on the rifle stock. His arms and shoulder present oblique angles to the incoming bullet. Rifle bullets that are used for military assault rifles are designed to turn or tumble on contact, allowing maximum energy to be imparted on the target within minimal penetration distance. Because of this inherent designed instability, rifle bullets have an extreme weakness in penetrating oblique angles. Rifle bullets will skip or tumble off of oblique surfaces. BDBA consists of a support structure that is attached to the user and an armor system that could consist of thin projectile deflecting plates. This structure and plate arrangement can be mounted on the user's arms, shoulders, chest, neck, and/or helmet. The support structure can be configured as an "exoskeleton" or an attachment system that connects directly to the body or helmet. The armor system attaches to the support structure. Armor system configurations can consist of very thin ballistic plates, which provide enough mass to deflect bullets at threat angles specified by the user. For example, a design requirement may require bullet deflection from directly in front of the user to 10 degrees to the right and left. Each plate in the armor system would be designed to deflect at corresponding angles in relationship to the specific armor piece's angle on the user's body. Shot-line analysis is also taken into consideration when integrating BDBA with conventional body armors. BDBA protected areas are normally not covered by conventional body armor. BDBA provides significant protection when the soldier is in these firing/fighting positions. Signature reduction technologies can also be incorporated in and on the ballistic and support structures. From the aforesaid description a definition of such technology includes: Definition: of Signature Reduction: Technologies that reduce the system's detectability to unaided eye (by using camouflage paint), thermal optics (by using insulators, heading or cooling system), radars (by using radar absorbing or defecting paints).

Armor systems can also be added to the helmet. Current helmets are not designed to stop or deflect rifle bullets. Deflection armor systems can be added to or designed into the helmet. The support structure that is on the user's shoulders can be used to connect the helmet. This attachment can be used to remove weight off the user's neck and provide energy absorption during a bullet impact.

H. CLAIMS

What I claim as my invention is:

1. A method for protecting a person in the line of fire comprising: providing concave and convex channels to a ballistic plate; providing the ballistic plate configured for support and mounting on one or both sides of a user; mounting the plate on a user to receive an impact of a bullet at an angle of incidence which is approaching from a frontal orientation and deflecting the bullet away from or parallel to said ballistic plate when said user is in a firing or fighting stance; and providing an attachment mechanism for connecting said ballistic plate to the sides of said user.

2. The method for protecting a person in the line of fire according to claim 1 further characterized by providing said attachment mechanism as a lightweight connector attached directly to one or more areas of the upper torso, arms, shoulders, neck, or head of a user.

3. The method for protecting a person in the line of fire according to claim 2 further characterized by attaching said ballistic plate to said lightweight connector for overlaying the body part to which said lightweight connector is attached.

4. The method for protecting a person in the line of fire according to claim 1 further characterized by providing said plate with integrating signature reduction elements.

5. The method for protecting a person in the line of fire according to claim 1 further characterized by providing said ballistic plate as first and second components layered with respect to one another and wherein said first component is operative to be penetrated by a ballistic particle; and further providing the first and second layered components with a space therebetween for deflecting the course of a ballistic particle penetrating the first component.

6. The method for protecting a person in the line of fire according to claim 1 further characterized by adding hinge portions to said ballistic plate to allow for first a closed position for ease of movement of the body portion to which it is connected and deployable onto a second portion for optimal protection of the same body portion when located in a firing or fighting position.

7. The method for protecting a person in the line of fire according to claim 6 providing said hinged portions with first and second portions each having adjacent edge portions and a hinge connecting said edge portions whereby said first portion can be folded into close overlaying relationship with said second portion; and said second portion being supported by said attachment mechanism to follow the contour of an upper body part in overlying relationship therewith.

8. The method for protecting a person in the line of fire according to claim 1 further characterized by providing ballistic plates with a plurality of separate parts each configured to cover a least one upper body part so as to minimize normal body movements of upper body parts covered by said separate parts.

9. The method for protecting a person in the line of fire according to claim 1 further characterized by applying onto a helmet said ballistic plate with a surface orientation to deflect the bullet away from the user.

10. The method for protecting a person in the line of fire according to claims 1 further characterized by providing a structural exoskeleton on the user and attaching said ballistic plate to the structural exoskeleton.

11. The method for protecting a person in the line of fire according to claim 10 further characterized by interconnecting frame elements to comprise the exoskeleton.

12. The method for protecting a person in the line of fire according to claim 1 further characterized by providing an exoskeleton including a first plurality of interconnected frame elements bounding the shoulder, a second plurality of interconnected frame elements bounding a forearm and a hinge connecting said first and second frame elements for allowing free movement of the forearm with respect to the shoulder as an attachment mechanism.

13. The method for protecting a person in the line of fire according to claim 1 further characterized by carrying said ballistic plate by attaching to the user's chest or back and so as to detach said ballistic plate with respect to the user's chest or back for mounting on other parts of the user's body.

14. The method for protecting a person in the line of fire according to claim 13 further characterized by using attaching or detaching connectors for said ballistic plate with respect to either the user's chest and/or back or with respect to one or more other areas of the upper torso, arms, shoulders, neck, or head of a user.

15. The method for protecting a person in the line of fire according to claim 1 further characterized by said attachment mechanism utilizing an exoskeleton with a load transfer adjustment element that can be adjusted to offset the weight of the armor system and the weight of additional loads, such as other equipment or weapons, carried by the user.

16. The method for protecting a person in the line of fire according to claim 1 further characterized by the integrating said ballistic plate with conventional torso mounted body armor systems for increased fighting and firing position protection.

17. The method for protecting a person in the line of fire according to claim 1 further characterized by mounting said attachment mechanism for support by the shoulders, upper arms or upper torso.

18. A body armor system comprising: a ballistic plate of lightweight ballistic metal or ceramic said ballistic plate incorporating concave and convex channels, wherein said concave channel is adapted to cover said user's extremity and the convex channel is adapted to be located either above or below the extremity.

19. The body armor system of claims 18 further characterize with built-up edges or bent edges on the exterior of said ballistic plate and of sufficient height to prevent a deflecting bullet and associated shrapnel from deflecting over the edge.

20. The body armor system of claim 18 further including a ballistic plate having first and second portions separated by a space for deflecting the course of a bullet penetrating one of the portions.

21. The body armor system of claim 18 including a structural exoskeleton configured to be supported on a user and said ballistic plate detachably supported on said structural exoskeleton.

22. The body armor system of claim 18 further including interconnecting frame elements in said structural exoskeleton.

23. The body armor system of claim 18 further including said structural exoskeleton including a first plurality of interconnected frame elements bounding the shoulder, a second plurality of interconnected frame elements bounding a forearm and a hinge connecting said first and second frame elements for allowing free movement of the forearm with respect to the shoulder as an attachment mechanism.

24. The body armor system of claim 23 further including load transfer or spring loaded hinges to counter balance the weight of said ballistic plates or other equipment loads.

25. The body armor system of claim 18 further including hinged first and second portions foldable into a first position for ease of movement of the body portion to which it is connected and deployable onto a second position for optimal protection of the same body portion when located in a firing or fighting position.

26. The body armor system of claim 25 wherein said first and second portions each have adjacent edges portions and a hinge connecting said edge portions whereby said first portion can be folded into close overlaying relationship with said second portion; said second portion being supported by an attachment mechanism to follow the contour of an upper body part in an overlying relationship therewith.

27. The body armor system of claim 18 further including an attachment mechanism that is connected to said ballistic plate and attaches to and detaches from an arm attaching system and reattaches to the chest or back.

* * * * *